US005431293A

United States Patent [19]

Piron

[11] Patent Number: 5,431,293

[45] Date of Patent: Jul. 11, 1995

[54] CHILD-PROOF CONTAINER CLOSURE AND LOCKING SYSTEM

[76] Inventor: Ludwig A. Piron, 339 Glenridge Drive, Waterloo, Ontario, Canada, N2J 3W7

[21] Appl. No.: 316,629

[22] Filed: Sep. 30, 1994

Related U.S. Application Data

[63] Continuation-in-part of Ser. No. 209,467, Mar. 14, 1994.

[51] Int. Cl.[6] ..... B65D 41/18; B65D 50/10; B65D 55/14

[52] U.S. Cl. ..... 215/206; 215/216; 215/225; 215/321

[58] Field of Search ..... 215/206, 216, 225, 253, 215/255, 256, 260, 280, 281, 282, 284, 287, 289, 290, 293, 301, 315, 326, 321

[56] References Cited

U.S. PATENT DOCUMENTS

| | | | |
|---|---|---|---|
| 3,638,285 | 2/1972 | Sanchez Giraldez | 24/108 |
| 3,782,147 | 1/1974 | Hallmann | 70/276 |
| 3,961,721 | 6/1976 | Gordon et al. | 220/230 |
| 4,223,799 | 9/1980 | Eyster et al. | 220/230 |
| 4,479,585 | 10/1984 | Sandhaus | 215/216 X |
| 4,573,598 | 3/1986 | Perry | 215/225 X |

FOREIGN PATENT DOCUMENTS 67616 7/1892 Germany .

*Primary Examiner*—Alan M. Shoap
*Assistant Examiner*—Nathan J. Newhouse
*Attorney, Agent, or Firm*—Richard L. Miller

[57] ABSTRACT

A container closure and locking system, allowing authorized access to the container when indicia on the locking system is correctly aligned. The container closure and locking system, for selectively allowing access to a container having a lip, comprising a container cap having an upper cap and lower cap. The lower cap comprises a main body having a main body bore. Latches mounted within the main body have a tail end, a hook that grips the lip, and a fulcrum between the tail end and hook. The tail end of each latch extends directly below the main body bore. The upper cap is rotatable to an unlocked position. The upper cap has a rotatable disk, having a plunger that can extend downward through the main body bore when the upper cap is in the operable position, to pivot each latch about its fulcrum, freeing its hook from the lip.

12 Claims, 4 Drawing Sheets

CHILD-PROOF CONTAINER CLOSURE AND LOCKING SYSTEM

CROSS REFERENCES

The present Application is a Continuation-In-Part application of Ser. No.: 08/209,467, Filed on, Mar. 14, 1994, titled: CONTAINER CLOSURE AND LOCKING SYSTEM, which is presently copending and for which there has been maintained a continuous chain of copendency.

The instant invention is also the subject matter of Disclosure Document No.: 347633, filed in the PTO on Feb. 9, 1994. It is respectfully requested that this document be retained beyond the two-year period so that it may be relied upon as evidence of conception of the invention during the prosecution phase of this application, should the need arise.

BACKGROUND OF THE INVENTION

The invention relates to a container closure and locking system. More particularly, the invention relates to a closure and locking system mounted on the top of a container, for selectively allowing or preventing access to the contents of the container.

Conventional container closure systems vary in complexity, ease of use, and protection against unauthorized access to the container contents.

Balancing the conflicting goals or container security and ease of use is always problematic. For example, conventional child-proof caps might provide marginal security to prevent a small child from accessing potentially harmful chemicals. However these child-proof caps can be difficult to operate, especially for someone who has limited dexterity from arthritis or other illness.

Other systems have been devised in an attempt to provide adequate security, but maintain ease of use to authorized persons. These systems are generally too complicated to be economical.

U.S. Pat. No. 3,638,285 to Sanchez Giraldez, discloses a two-part lock button that is actuated by a magnetic key.

U.S. Pat. No. 3,782,147 to Hallmann, discloses a security lock employing a bolting unit that is movable by the proper orientation of magnets in a key.

U.S. Pat. No. 3,961,721 to Gordon et al., discloses a magnetic container cover, in which the cover is held in position by magnetic force.

U.S. Pat. No. 4,223,799 to Eyster et al., discloses a releasable locking means for closure caps.

German Patent No. 67616 to Abramowsky, discloses a locking mechanism.

While these units may be suitable for the particular purpose for which they are employed, or to general use, they would not be as suitable for the purposes of the present invention as hereafter described.

SUMMARY OF THE INVENTION

It is an object of the invention to produce a container closure and locking system that prevents unauthorized access to the contents of a container. The system further prevents access by "brute force".

It is another object of the invention to produce a container closure system that requires little effort to open when it is placed in an unlocked position, but which may not be opened, when it is in a locked position.

It is a further object of the invention to produce a container closure system that has a minimal number of parts, is self-contained, and can be economically manufactured.

It is a still further object of the invention to produce a container closure system that can be used on a variety of containers.

The invention is a container closure and locking system, for selectively allowing access to a container having a 18 lip, comprising a container cap having an upper cap and lower cap. The lower cap comprises a main body having a main body bore. Latches mounted within the main body have a tail end, a hook that grips the lip, and a fulcrum between the tail end and hook. The tail end of each latch extends directly below the main body bore. The upper cap is rotatable to an unlocked position. The upper cap has a rotatable disk, having a plunger that can extend downward through the main body bore when the upper cap is in the operable position, to pivot each latch about its fulcrum, freeing its hook from the lip.

To the accomplishment of the above and other related objects, the invention may be embodied in the form illustrated in the accompanying drawings. Attention is called to the fact that the drawings are illustrative only. Variations are contemplated as being part of the present invention, limited only by the scope of the claims.

BRIEF DESCRIPTION OF THE DRAWINGS

In the drawings, like elements are indicated by like reference numerals throughout the several views. The drawings are briefly described below.

DETAILED DESCRIPTION OF THE PREFERRED EMBODIMENTS

Figure 1:
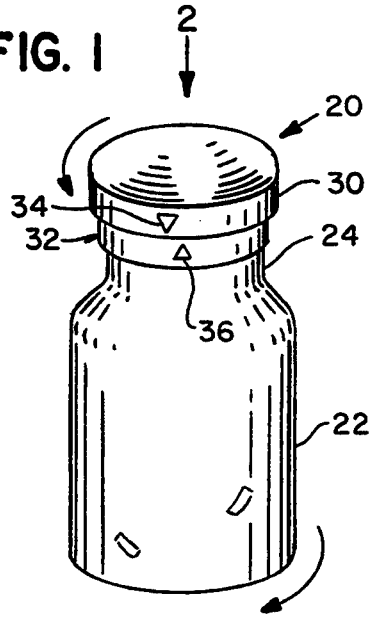
FIG. 1 is a diagrammatic perspective view of the instant invention installed on a typical medicine container, with the cap shown in a locked position where it cannot be depressed sufficiently to release any latches.

FIG. 1 illustrates a container cap 20 shown seated on top of a container 22. The container 22 has an open end 24, where the container cap 20 is seated. The container cap 20 has an upper cap 30 and a lower cap 32. The upper cap 30 has an upper cap indicia 34. The lower cap 32 has lower cap indicia 36. As indicated, the upper cap 30 and lower cap 32 can rotate relative to one another, altering the relative positions of the upper cap indicia 34 and lower cap indicia 36. As shown in this view, the container cap 20 is in a locked position, where the upper cap indicia 34 and lower cap indicia 36 are not aligned.

Figure 2:
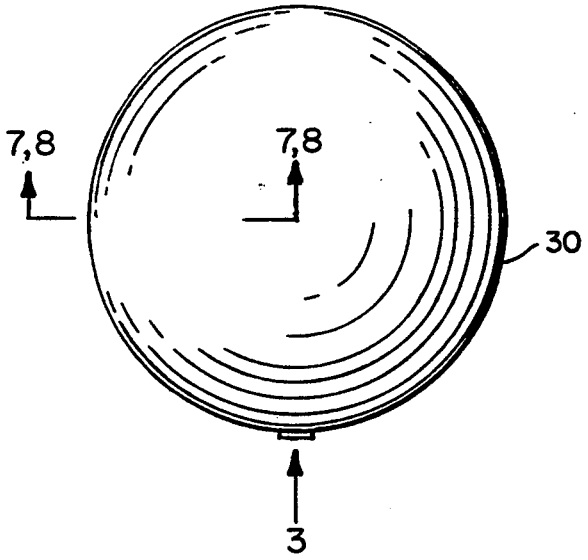
FIG. 2 is an enlarged diagrammatic perspective view of just the instant invention per se installed thereon, with parts broken away.

FIG. 2 illustrates the upper cap 30 in plan view. The upper cap 30 is typically convex in an upward direction. Its convex curvature allows the upper cap 30 to fit comfortably within the palm of a person operating the container cap 20.

Figure 3:
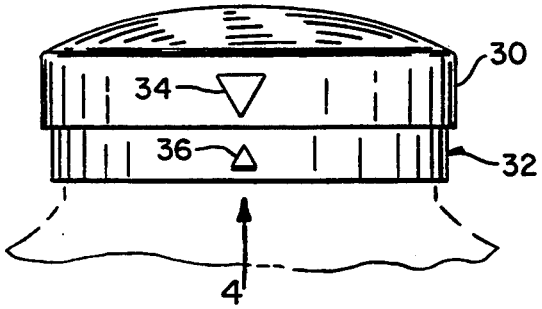
FIG. 3 is an elevational view taken in the direction of arrow 3 in FIG. 2, with the cap shown in a position ready to be depressed sufficiently so that all the latches will be released.

FIG. 3 details the container cap 20. As shown in this view, the upper cap 30 and lower cap 32 are in an unlocked position, wherein the upper cap indicia 34 and lower cap indicia 36 are aligned.

Figure 7:
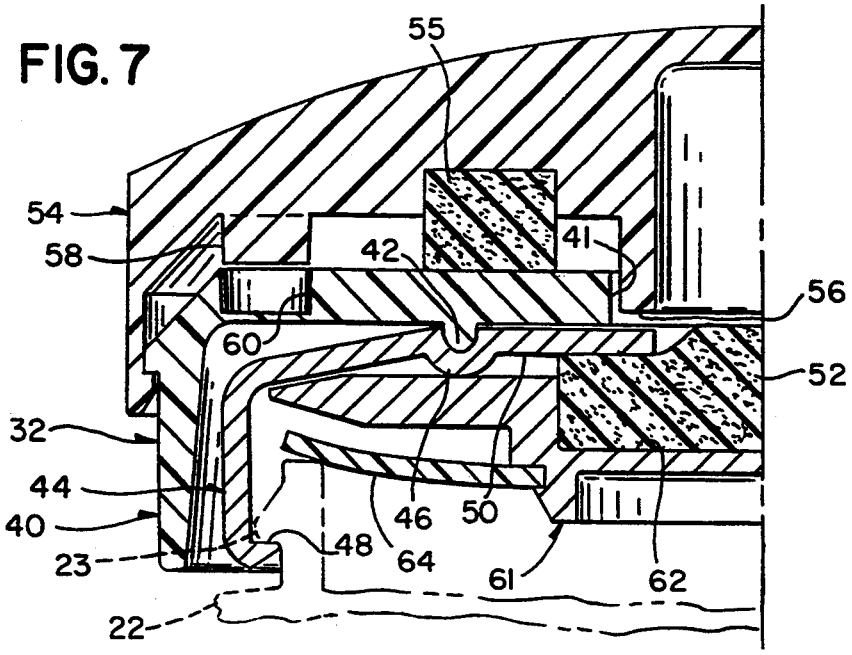
FIG. 7 is an enlarged cross sectional view taken on line 7—7 of FIG. 2, and in the area of the dotted circle indicated by arrow 7 in FIG. 5, with the cap shown in a position ready to be depressed sufficiently so that all latches will be released.

FIG. 7 is a cross-sectional view illustrating operational details of the container cap 20. The container cap 20 rests upon the container 22 which has a lip 23. The lower cap 32 has a main body 40. The main body 40 has a main body bore 41. The .main body has a pivot point 42. A latch 44, mounted within the main body 40, has a fulcrum 46 that rests against the pivot point 42. The latch 44 also has a hook 48 that grasps the lip 23 of the container 22, and a tail end 50 on an opposite side of the fulcrum 46 from the hook 48. The fulcrum 46 is disposed between the hook 48 and tail end 50. A portion of the tail end 50 of the latch 44 extends directly below the main body bore 41. A central spring 52, preferably made of foam material, exerts an upward pressure against the tail end 50, to bias the hook 48 against the lip 23.

The upper cap 30 has a rotatable disk 54, mounted atop the main body 40, capable of rotation thereon. A spacer toroid 55, made of foam material, is mounted between the rotatable disk 54 and main body 40 in a toroid recess 57 in the rotatable disk 54. The rotatable disk 54 has a plunger 56 which extends through a main body bore 41 into the main body 40.

Figure 8:
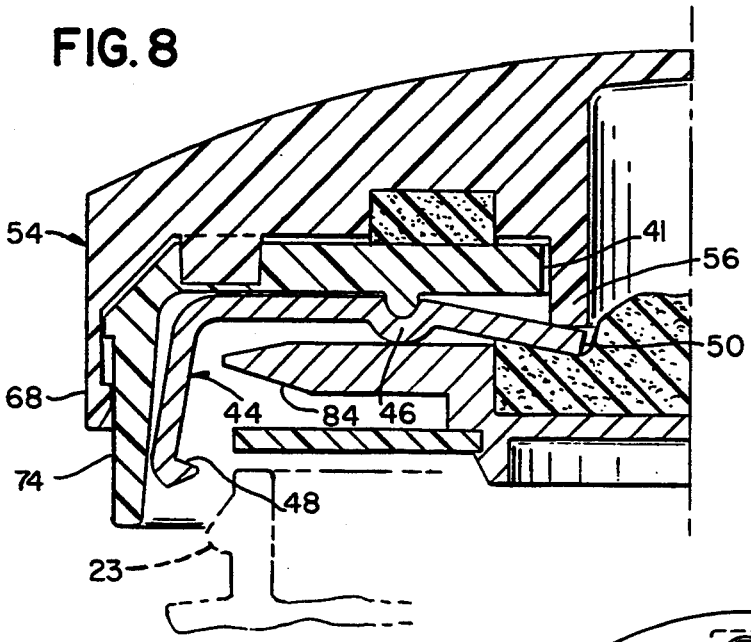
FIG. 8 is an enlarged cross sectional view taken on line 8—8 of FIG. 2, and in the area of the dotted circle indicated by arrow 8 in FIG. 5, with the cap shown in an unlocked position, depressed sufficiently so that all the latches have been released.

Referring to FIG. 8, when the rotatable disk 54 is pressed downward, the plunger 56 extends downward through the main body bore 41, pressing downward against the tail end 50 of the latch 44. The downward force of the plunger 56 easily overcomes the upward force of the central spring 52, pivoting the latch 44 about its fulcrum 46, swinging the hook 48 clear of the lip 23.

Referring back to FIG. 7, the rotatable disk 54 has inhibitor pegs 58 that correspond to enabler holes 60 in the main body 40. When the rotatable disk 54 is pressed downward, the inhibitor pegs 58 extend fully downward into their corresponding enabler holes 60. As illustrated in FIG. 8, where the inhibitor pegs 58 have extended fully into corresponding enabler holes 60, the spacer toroid 55 is also compressed by the downward pressure of the rotatable disk 54 upon the main body 40.

Figure 5:
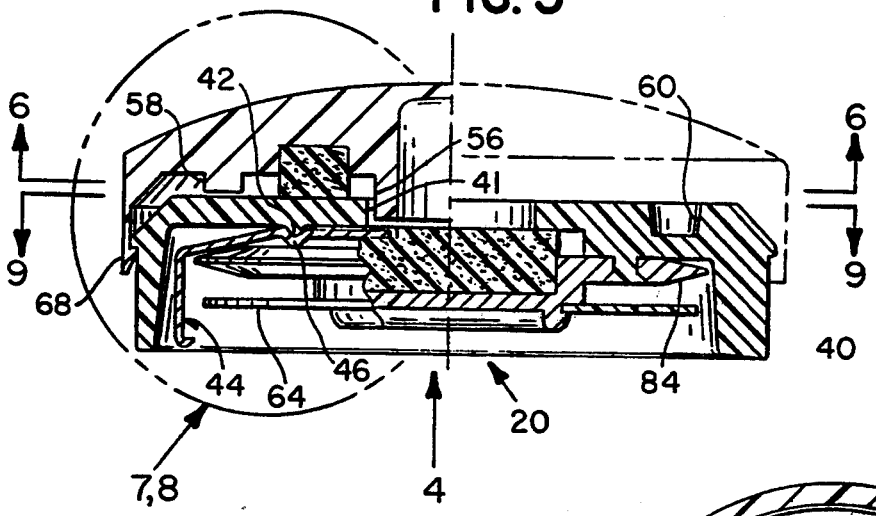
FIG. 5 is a diagrammatic cross sectional view with parts broken away, taken on cut 5—5 in FIG. 4, with the cap shown in a locked position where it cannot be depressed sufficiently to release any latches.

Referring to FIG. 5, the rotatable disk 54 is rotated to the locked position. In the locked position, the inhibitor pegs 58 are not lined up with corresponding enabler holes 60. Interference between the inhibitor pegs and the main body 40 prevents downward movement of the plunger 56 into the main body bore 41. Therefore, this interference renders the container cap 20 unopenable by preventing the latches from being operated.

Referring again to FIG. 7, The lower cap 32 further comprises a bottom plate 61, mounted beneath the main body 40. The central spring 52 is mounted snugly in a central spring recess 62 in the bottom plate 61. The bottom plate 61 has a flexing seal 64 that approximates the diameter of the open end 24 of the container 22. The flexing seal 64, made of a resilient material, creates a seal against the container 22 to prevent contamination of its contents. Further, the flexing seal 64 is slightly flexed while the hook 48 grips the lip 23, storing energy in a spring-like fashion. When the hook 48 releases the lip 23, potential energy stored in the flexing seal 64 releases, causing an upward surge of the container cap 20 into the hands of the user. The container cap 20 is then lifted up and away from the container 20.

Figure 6:
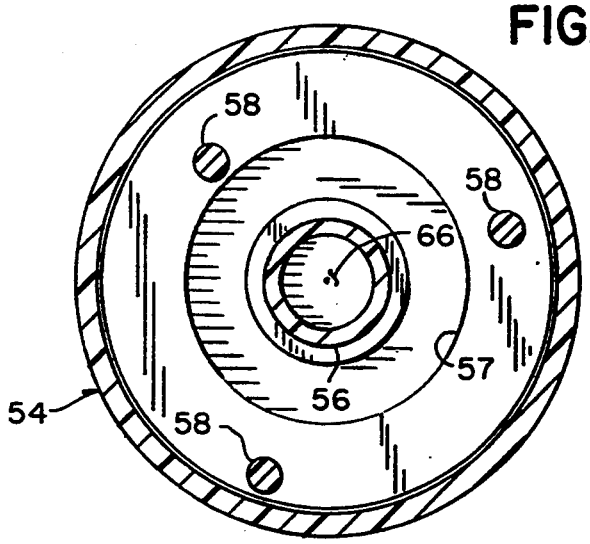
FIG. 6 is a reduced cross sectional view taken on line 6—6 of FIG. 5.

FIG. 6 illustrates, in bottom plan view, the rotatable disk 54 per se. The rotatable disk 54 has a rotatable disk center 66. The inhibitor pegs 58 are located at different radial distances from the rotatable disk center 66. The plunger 56 is concentric with the rotatable disk 54. The toroid recess 57 is concentric with the plunger 56, and has a larger diameter than the plunger 56. The rotatable disk 54 has an outer rim 68 extending downward.

Figure 10:
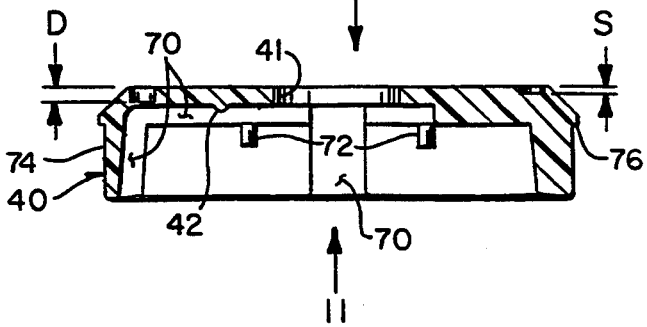
FIG. 10 is a cross sectional view taken on cut 10—10 of FIG. 9 with parts broken away.

FIG. 10 illustrates the main body 40 in section. The main body has a main body center, which corresponds to the center of the main body bore 41. The main body 40 has a latch cavity 70 for each latch 44. As a manner of design choice, it is preferable to utilize at least two latches 44, and no limitation is to be implied by typically illustrating four in this particular description. The pivot point 42 is located in each latch cavity 70. Connecting pins 72 attach the bottom plate 61 to the main body 40. The main body 40 has an outer track 74, and outer stop 76. The outer rim 68 of the rotatable disk mates with the outer track 74, for stable vertical motion thereupon. The outer stop 76 is a notch at the end of the outer track 74 that defines a limit of the vertical motion of the rotatable disk 54 to prevent it from being pulled completely off the main body 40.

Figure 4:
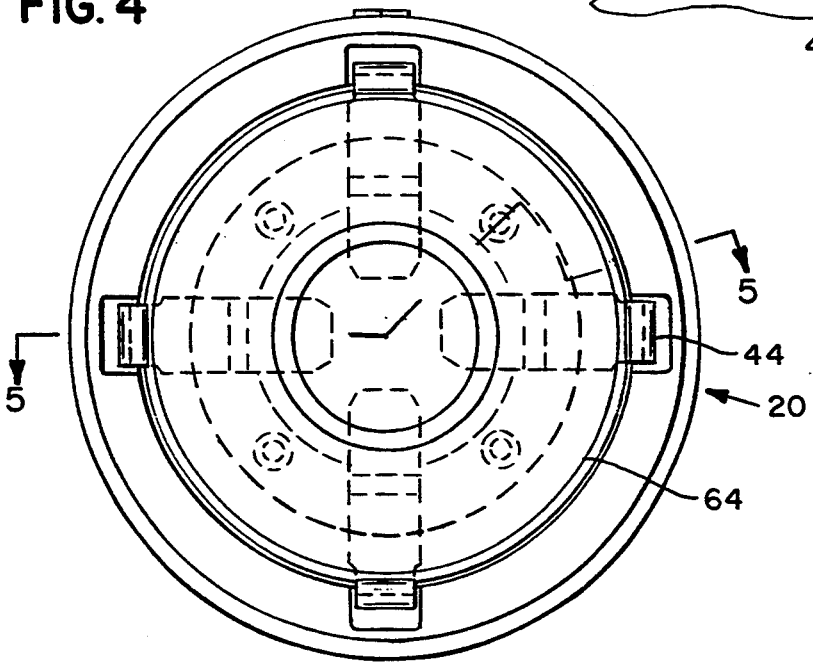
FIG. 4 is an enlarged bottom elevational view taken in the direction of arrow 4 in FIG. 3.

Referring to FIG. 4, which is a bottom plan view of the container cap 20, each latch extends radially outward slightly beyond the circumference of the flexing seal 64.

Figure 9:
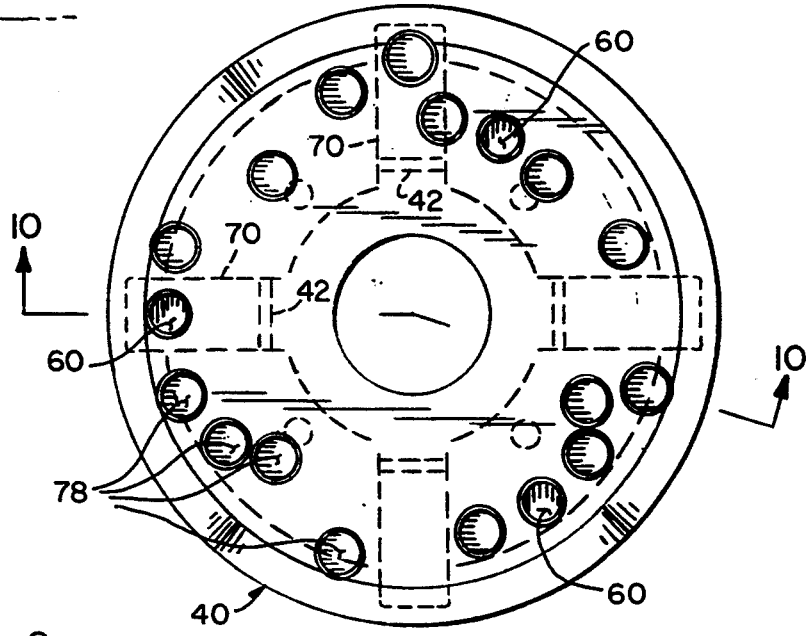
FIG. 9 is a cross sectional view taken on line 9—9 of FIG. 5, with parts broken away.

FIG. 9 is a plan view, illustrating the main body 40. The enabler holes 60 are mounted at positions that correspond to the radial positioning of the inhibitor pegs on the rotatable disk 54 as illustrated in FIG. 6. The inhibitor pegs are lined up with the enabler holes 60 when the container cap 10 is in the unlocked position. These enabler holes 60 have sufficient depth so as to allow the downward movement of the plunger 56 to disengage the latches 44. By contrast, disablement holes 78 are disposed on the main body 40 at radial distances from the center of the main body that correspond to the radial distance of the enabler holes 60. The disablement holes do not have sufficient depth to allow the sufficient downward movement of the plunger 56 to disengage the latches 44. If the rotatable disk 54 is rotated atop the main body 40 while pressing downward upon the rotatable disk 54, the inhibitor pegs will catch upon one of the sets of disablement holes 78. When one of the inhibitor pegs catches one of the disablement holes, the rotatable disk 54 and main body 40 will rotate upon the container 22 as a unit. The container cap 10 will never reach the operable position, thus preventing the opening of the container cap 10 by "brute force".

As illustrated in FIG. 9, the latch cavities 70 extend radially from the center of the main body 40. The pivot point 42 in each latch cavity 70 extends perpendicular to radii of the main body that bisect that pivot point 42.

Figure 11:
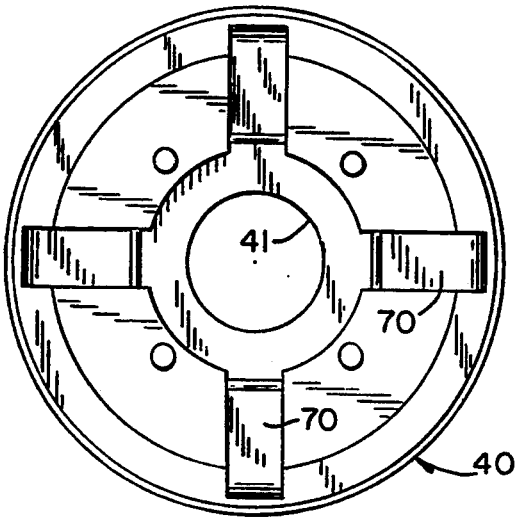
FIG. 11 is an elevational view taken in the direction of arrow 11 in FIG. 10.

FIG. 11 is a bottom plan view of the main body 40, illustrating the relative positioning of the main body bore 41, and the latch cavities 70 that extend radially outward therefrom.

Figure 12:
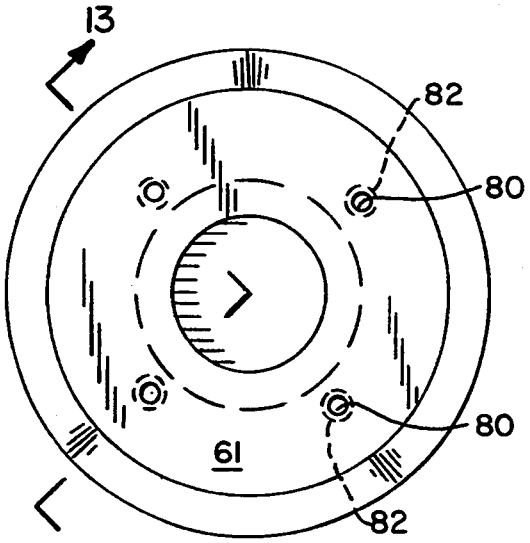
FIG. 12 is an elevational view of the bottom plate component of the instant invention.

FIG. 12 is a plan view illustrating the bottom plate 61. The bottom plate has connecting pin holes 80 that correspond to the connecting pins 72 on the main body 40. The connecting pin holes each have a peen recess 82. The bottom plate is attached to the main body 40 by inserting the connecting pins 72 into the connecting pin holes 80, and then peening them typically utilizing ultrasonics techniques. The peened ends of each connecting pins 72 fit snugly within the peen recess 82.

Figure 13:
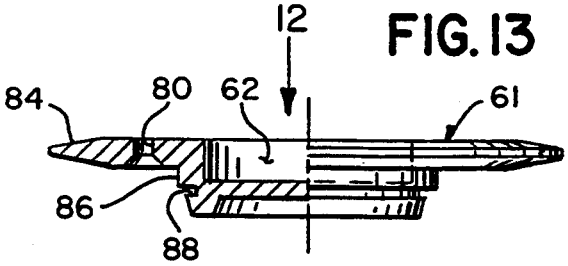
FIG. 13 is a view partially in cross section taken on cut 13—13 in FIG. 12.

FIG. 13 illustrates the bottom plate 61 in partial section. The bottom plate 61 has a tapered disk 84 and a seal mount 86. The seal mount 86 has a seal recess 88 notched into the seal mount 86. The flexing seal is mounted in the seal recess 88. The connecting pin holes 80 are positioned on the bottom plate 61 near the tapered disk 84. The central spring recess 62 extends into the bottom plate 61 at its center.

Figure 14:
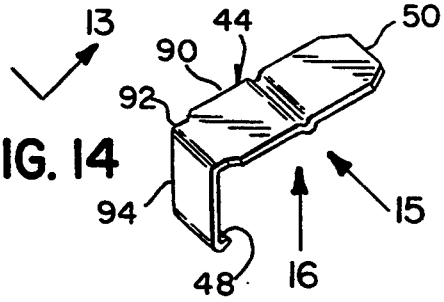
FIG. 14 is a diagrammatic perspective view of a single latch per se.

FIG. 14 is a diagrammatic perspective view illustrating the latch 44. The latch is L-shaped, having a first leg 94 and a second leg 90, meeting at a bend 92. The hook 48 is on the first leg 94 of the latch 44, opposite the bend 92. The tail end 50 is on the second leg 90, opposite the bend 92. The fulcrum 46 is on the second leg 90 disposed between the tail end 50 and the bend 92.

Figure 15:
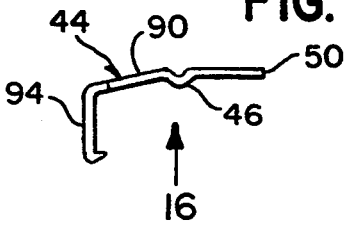
FIG. 15 is a side elevational view taken in the direction of arrow 15 in FIG. 16.
Figure 16:
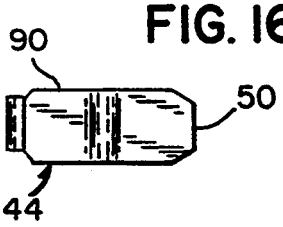
FIG. 16 is a bottom elevational view taken in the direction of arrow 16 in FIG. 14 and FIG. 15.

FIG. 15 and FIG. 16 further illustrate the shape of the latch 44. As illustrated, the second leg 90 is substantially rectangular, with chamfer corners. The fulcrum 46 is convex toward the interior of the L-shape formed by the first leg 94 and second leg 90.

In conclusion, a container closure system is provided that allows a container to be opened when the upper cap is in the unlocked position, and prevents access when the upper cap is in locked positions, and when an attempt is made to open the container closure system by brute force. Thus the conflicting goals of convenient container access by adult authorized individuals verses child safety are fully reconciled.

What is claimed is:

1. A container closure and locking system, for closing and selectively allowing access to a container, the container having an open end and a lip near the open end, comprising:

a) an upper cap having a plunger;

b) a lower cap, comprising a main body, the main body having a main body bore and a pivot point, the plunger capable of extending downward through the main body bore;

c) a latch, mounted within the main body, the latch having a hook which grasps the lip, the latch also having a tail end, a portion of the tail end extends directly below the main body bore, the latch further having a fulcrum between the hook and tail end that rests against the pivot point; and d) a central spring beneath the plunger, the central spring pressing upward against the tail end to keep the fulcrum biased against the pivot point to maintain the hook in position grasping the lip and lower cap.

2. The container closure and locking system as recited in claim 1, wherein the upper cap rotates upon the main body, the upper cap having upper cap indicia, the lower cap having lower cap indicia, the upper cap rotates to an unlocked position where the upper cap indicia is aligned with the lower cap indicia.

3. The container closure and locking system as recited in claim 2, having at least two latches, and at least two pivot points in the main body.

4. The container closure and locking system as recited in claim 1, having three latches, and having three pivot points in the main body.

5. The container closure and locking system as recited in claim 3, wherein the rotatable disk has inhibitor pegs and the main body has enabler holes, when the upper cap is in the unlocked position the inhibitor pegs are aligned with the enabler holes.

6. The container closure and locking system as recited in claim 5, the lower cap further comprising a bottom plate mounted beneath the main body, the bottom plate having a central spring recess within which the central spring is located and a flexing seal for creating a seal upon the container.

7. The container closure and locking system as recited in claim 6, where the main body further comprises a latch cavity for each latch, the latch cavities extending radially from the main body bore, the pivot point located in each latch cavity, each pivot point extending perpendicular to radii of the main body that bisect that pivot point.

8. The container closure and locking system as recited in claim 7, wherein the main body further comprises at least two connecting pins, and the bottom plate has matching connecting pin holes for rigidly attaching the main body to the bottom plate.

9. The container closure and locking system as recited in claim 7, wherein each latch is L-shaped, having a first leg and a second leg meeting at a bend, the hook is on the first leg opposite the bend, the tail end is on the second leg opposite the bend, and the fulcrum is on the second leg between the bend and the tail end.

10. A method for locking, and selectively opening a container having a lip, with a container cap having an upper cap having a plunger and a lower cap having a main body having a main body bore, and a latch mounted in a latch cavity in the main body, the latch resting against a pivot point in the main body, the latch having a hook and a tail end, comprising the steps of:

a) sealing the container, by griping the lip with the hook, to hold the container cover to the container;

b) rotating the upper cap until it enters an operable position; and c) releasing the container cap from the container, by pressing down upon the container cover to move the plunger into the main body bore, to press down upon the tail end of the latches so that they pivot about their pivot points, freeing the latch hook from the container lip.

11. The method as recited in claim 10, wherein the lower cap further comprises a bottom plate attached to the main body, and the step of sealing the container further comprises sealing the container with a flexing seal mounted to the bottom plate.

12. The method as recited in claim 10, further comprising the step of lifting the container cover up and away from the container.

* * * * *